US008684770B2

(12) United States Patent
Tai et al.

(10) Patent No.: US 8,684,770 B2
(45) Date of Patent: Apr. 1, 2014

(54) CABLE END CONNECTOR AND CABLE CONNECTOR ASSEMBLY HAVING THE SAME

(75) Inventors: Hung-Chi Tai, Jhonghe (TW); Yong-Gang Zhang, Taicang (CN); Kun Liu, Taicang (CN)

(73) Assignee: Alltop Electronics (Suzhou) Ltd., Taicang, JiangSu Province (CN)

( * ) Notice: Subject to any disclaimer, the term of this patent is extended or adjusted under 35 U.S.C. 154(b) by 49 days.

(21) Appl. No.: 13/466,677

(22) Filed: May 8, 2012

(65) Prior Publication Data

US 2013/0203283 A1 Aug. 8, 2013

(30) Foreign Application Priority Data

Feb. 6, 2012 (CN) ..... 2012 1 0025035

(51) Int. Cl.
*H01R 13/648* (2006.01)

(52) U.S. Cl.
USPC ..... 439/607.41; 439/497

(58) Field of Classification Search
USPC ..... 439/607.41–607.52, 497, 579
See application file for complete search history.

(56) References Cited

U.S. PATENT DOCUMENTS 4,615,578 A * 10/1986 Stadler et al. ..... 439/607.47
4,721,483 A * 1/1988 Dickie ..... 439/607.49
4,758,179 A * 7/1988 Klein et al. ..... 439/497
4,773,878 A * 9/1988 Hansell, III ..... 439/497
4,781,620 A * 11/1988 Tengler et al. ..... 439/497
4,786,257 A * 11/1988 Tengler ..... 439/76.1
5,057,038 A * 10/1991 Bowen et al. ..... 439/497
5,085,596 A * 2/1992 Bowen et al. ..... 439/497
5,387,130 A * 2/1995 Fedder et al. ..... 439/607.47
5,967,832 A * 10/1999 Ploehn ..... 439/497
6,017,245 A * 1/2000 Karir ..... 439/607.45
6,062,907 A * 5/2000 Tan et al. ..... 439/607.41
6,077,105 A * 6/2000 Jochen et al. ..... 439/497
6,120,319 A * 9/2000 Lee et al. ..... 439/497
6,162,086 A * 12/2000 Kuo ..... 439/497
6,174,195 B1 * 1/2001 Yang ..... 439/497
6,193,545 B1 * 2/2001 Lee et al. ..... 439/497
6,273,753 B1 * 8/2001 Ko ..... 439/579
6,280,242 B1 * 8/2001 Jochen et al. ..... 439/497
6,290,542 B1 * 9/2001 Kuo ..... 439/607.49
6,309,243 B1 * 10/2001 Tu et al. ..... 439/497
6,454,606 B2 * 9/2002 Igarashi ..... 439/607.41
6,533,607 B2 * 3/2003 Jochen et al. ..... 439/497
6,638,100 B2 * 10/2003 Fogg et al. ..... 439/497
6,645,002 B1 * 11/2003 Lee ..... 439/497
6,659,800 B1 * 12/2003 Wu ..... 439/607.11
6,685,495 B1 * 2/2004 Ko ..... 439/353

(Continued)

*Primary Examiner* — Ross Gushi
(74) *Attorney, Agent, or Firm* — Sughrue Mion, PLLC

(57) ABSTRACT

A cable connector assembly has a first connector, a second connector and a ribbon cable connecting the first and the second connectors. The first connector includes a first insulating housing, a number of first contacts and a first shielding covering the first insulating housing. Each first contact includes a first contacting portion, a first retaining portion and a first connection portion. The first shielding has a first grounding section. The second connector includes a second insulating housing, a number of second contacts and a second shielding. Each second contact includes a second contacting portion, a second retaining portion and a second connection portion. The second shielding has a second ground section. The ribbon cable includes a number of wires, each wire having one end electrically connecting with the first connection portions and the first grounding section and having the other end electrically connecting the second connection portions and the second ground section.

19 Claims, 9 Drawing Sheets

(56) References Cited

U.S. PATENT DOCUMENTS

| | | | | |
|---|---|---|---|---|
| 6,705,896 | B1 * | 3/2004 | Chang et al. | 439/607.44 |
| 6,755,687 | B1 * | 6/2004 | Ko | 439/579 |
| 6,793,527 | B2 * | 9/2004 | Noro | 439/579 |
| 6,830,478 | B1 * | 12/2004 | Ko | 439/579 |
| 6,866,539 | B2 * | 3/2005 | Chang | 439/460 |
| 6,913,485 | B2 * | 7/2005 | Ko | 439/579 |
| 6,923,682 | B2 * | 8/2005 | Akama et al. | 439/607.47 |
| 6,932,640 | B1 * | 8/2005 | Sung | 439/405 |
| 6,951,477 | B2 * | 10/2005 | Tondreault et al. | 439/497 |
| 7,001,213 | B2 * | 2/2006 | Kaneko et al. | 439/579 |
| 7,052,292 | B2 * | 5/2006 | Hsu et al. | 439/98 |
| 7,214,097 | B1 * | 5/2007 | Hsu et al. | 439/607.47 |
| 7,220,146 | B2 * | 5/2007 | Miyazaki | 439/579 |
| 7,223,120 | B2 * | 5/2007 | Ko | 439/492 |
| 7,311,552 | B1 * | 12/2007 | Ko | 439/579 |
| 7,322,852 | B2 * | 1/2008 | Nagata et al. | 439/579 |
| 7,351,100 | B2 * | 4/2008 | Yodogawa | 439/579 |
| 7,354,299 | B2 * | 4/2008 | Yamada et al. | 439/497 |
| 7,361,049 | B2 * | 4/2008 | Nagata et al. | 439/497 |
| 7,534,143 | B1 * | 5/2009 | Tsao et al. | 439/607.41 |
| 7,601,029 | B2 * | 10/2009 | Horiuchi et al. | 439/607.01 |
| 7,637,779 | B2 * | 12/2009 | Nagata et al. | 439/607.49 |
| 7,717,733 | B1 * | 5/2010 | Yi et al. | 439/452 |
| 7,878,843 | B2 * | 2/2011 | Zhang | 439/497 |
| 7,931,493 | B2 * | 4/2011 | Cheng | 439/497 |
| 7,934,957 | B1 * | 5/2011 | Nakajima et al. | 439/607.49 |
| 7,993,157 | B2 * | 8/2011 | Azizi-Namini | 439/493 |
| 8,002,572 | B2 * | 8/2011 | Lu et al. | 439/405 |
| 8,052,461 | B2 * | 11/2011 | Wang | 439/405 |
| 8,398,427 | B2 * | 3/2013 | Wu | 439/497 |
| 8,403,698 | B2 * | 3/2013 | Su et al. | 439/455 |
| 2003/0114046 | A1 * | 6/2003 | Noro | 439/579 |
| 2005/0075009 | A1 * | 4/2005 | Ko | 439/579 |
| 2006/0019529 | A1 * | 1/2006 | Ko | 439/497 |
| 2006/0035522 | A1 * | 2/2006 | Kuroda et al. | 439/610 |
| 2006/0252310 | A1 * | 11/2006 | Yamada et al. | 439/579 |
| 2007/0141907 | A1 * | 6/2007 | Kuo et al. | 439/607 |
| 2007/0141909 | A1 * | 6/2007 | Nagata et al. | 439/610 |
| 2008/0003874 | A1 * | 1/2008 | Ko | 439/579 |
| 2008/0132112 | A1 * | 6/2008 | Nagata et al. | 439/499 |
| 2009/0047825 | A1 * | 2/2009 | Wu | 439/497 |
| 2009/0068890 | A1 * | 3/2009 | Horiuchi et al. | 439/610 |
| 2010/0029133 | A1 * | 2/2010 | Cheng | 439/607.47 |
| 2010/0216342 | A1 * | 8/2010 | Lin | 439/607.49 |
| 2011/0250783 | A1 * | 10/2011 | Su et al. | 439/404 |
| 2011/0281469 | A1 * | 11/2011 | Su et al. | 439/660 |
| 2012/0302077 | A1 * | 11/2012 | Wu | 439/135 |
| 2013/0078858 | A1 * | 3/2013 | Wu et al. | 439/607.41 |
| 2013/0203283 | A1 * | 8/2013 | Tai et al. | 439/404 |

* cited by examiner

CABLE END CONNECTOR AND CABLE CONNECTOR ASSEMBLY HAVING THE SAME

BACKGROUND OF THE INVENTION

1. Field of the Invention

The present invention relates to an electrical connector, and more particularly to a cable end connector and a cable connector assembly having the same.

2. Description of Related Art

Usually, a cable end connector meeting USB 3.0 specification always employs a plurality of round wires to electrically and mechanically connect to a plug connector. In order to improve the effect of shielding, it needs to redesign the grounding path in the cable end connector and the plug connector. US Publication No. 20080207021 discloses a conventional cable end connector assembly, in which a printed circuit board is used to transmitting signal to thereby a better shield effect. Obviously, the employment of the printed circuit board in the connector will inevitably increase the product cost.

Hence, a cable connector assembly with improved structure to settle above-described disadvantages is desired.

BRIEF SUMMARY OF THE INVENTION

The present invention provides a cable connector assembly in accordance with the present invention. The cable connector assembly comprises a first connector, a second connector and a ribbon cable connecting the first and the second connectors. The first connector comprises a first insulating housing, a plurality of first contacts assembled on the first insulating housing, and a first shielding covering the first insulating housing. Each first contact comprises a first contacting portion, a first retaining portion and a first connection portion. The first shielding has a first grounding section. The second connector comprises a second insulating housing, a plurality of second contacts assembled on the second insulating housing and a second shielding covering the second insulating housing. Each second contact comprises a second contacting portion, a second retaining portion and a second connection portion. The second shielding has a second ground section. The ribbon cable comprises a plurality wires, each wire having one end electrically connecting with the first connection portions and the first grounding section and having the other end electrically connecting the second connection portions and the second ground section.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
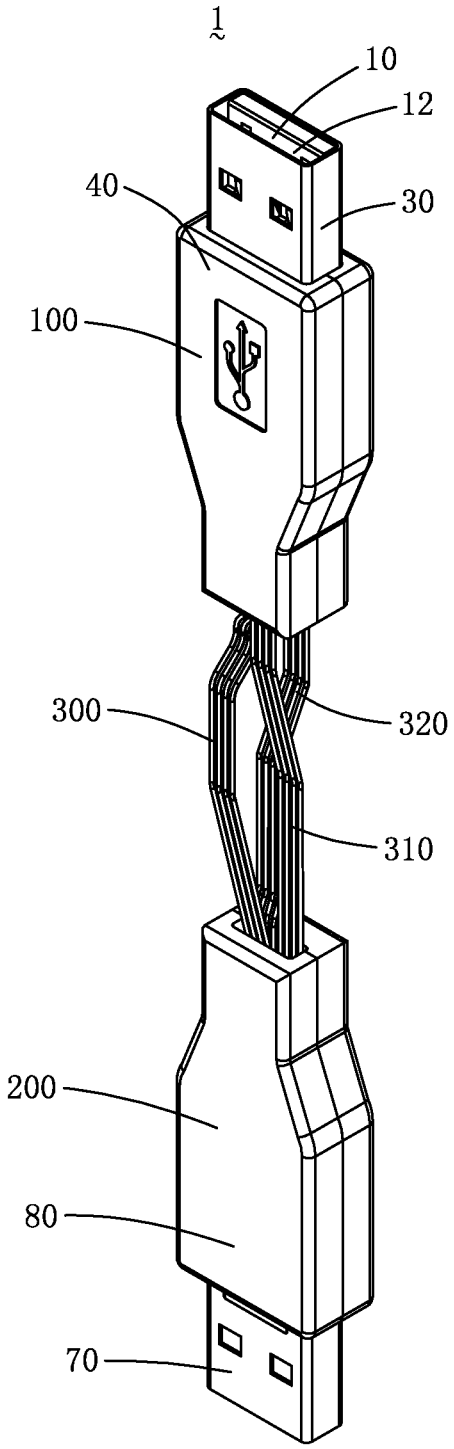
FIG. 1 is a perspective view of a cable connector assembly in accordance with the present invention.

Reference will now be made to the drawing figures to describe the embodiments of the present invention in detail. In the following description, the same drawing reference numerals are used for the same elements in different drawings.

Figure 2:
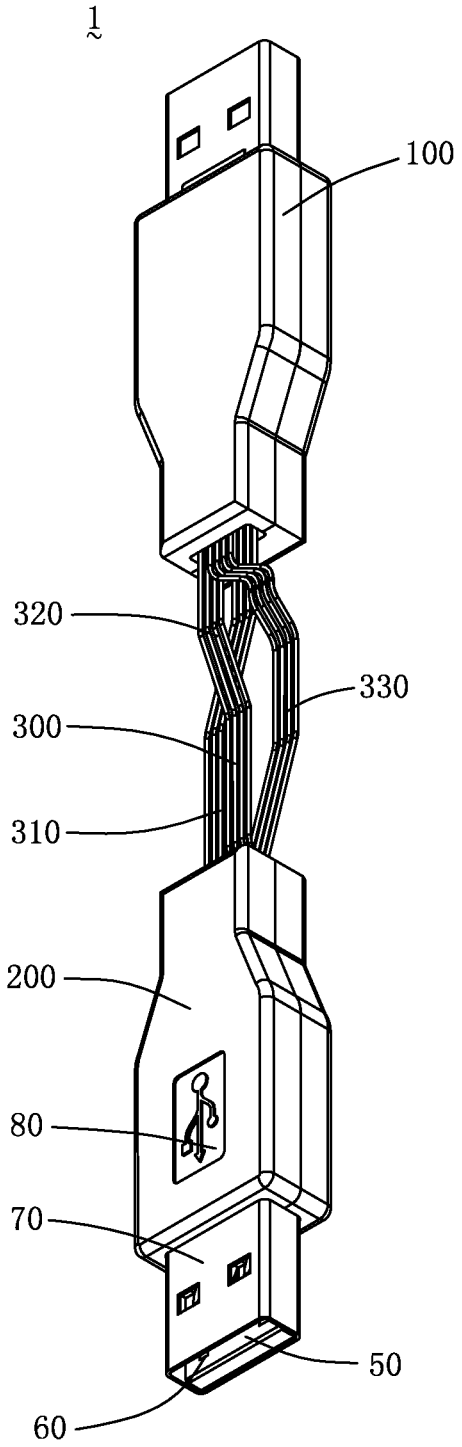
FIG. 2 is a perspective view similar to FIG. 1 while taken from another aspect.
Figure 3:
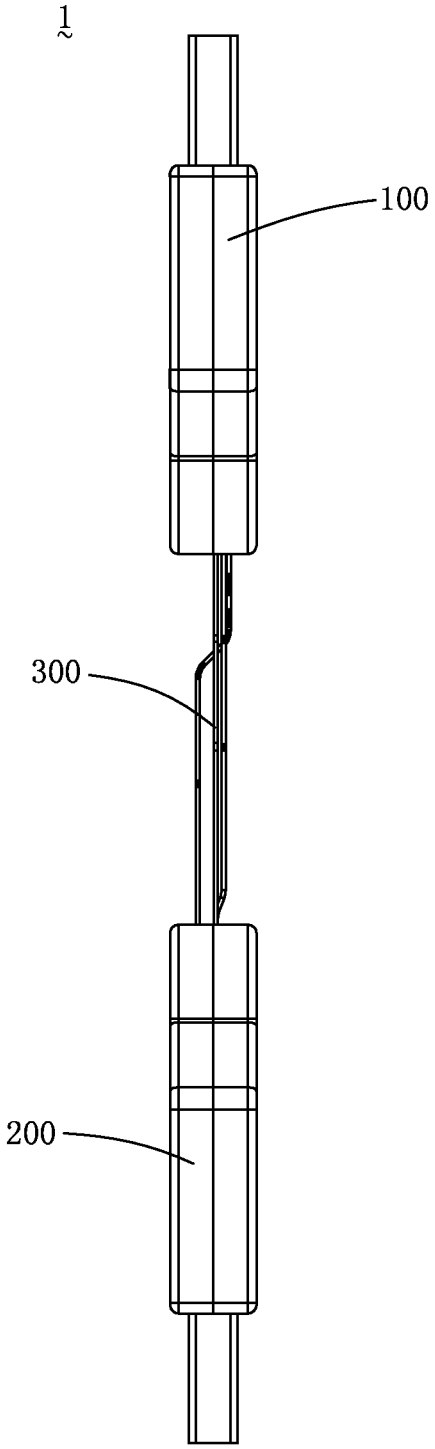
FIG. 3 is a side view of the cable connector assembly shown in FIG. 1.
Figure 4:
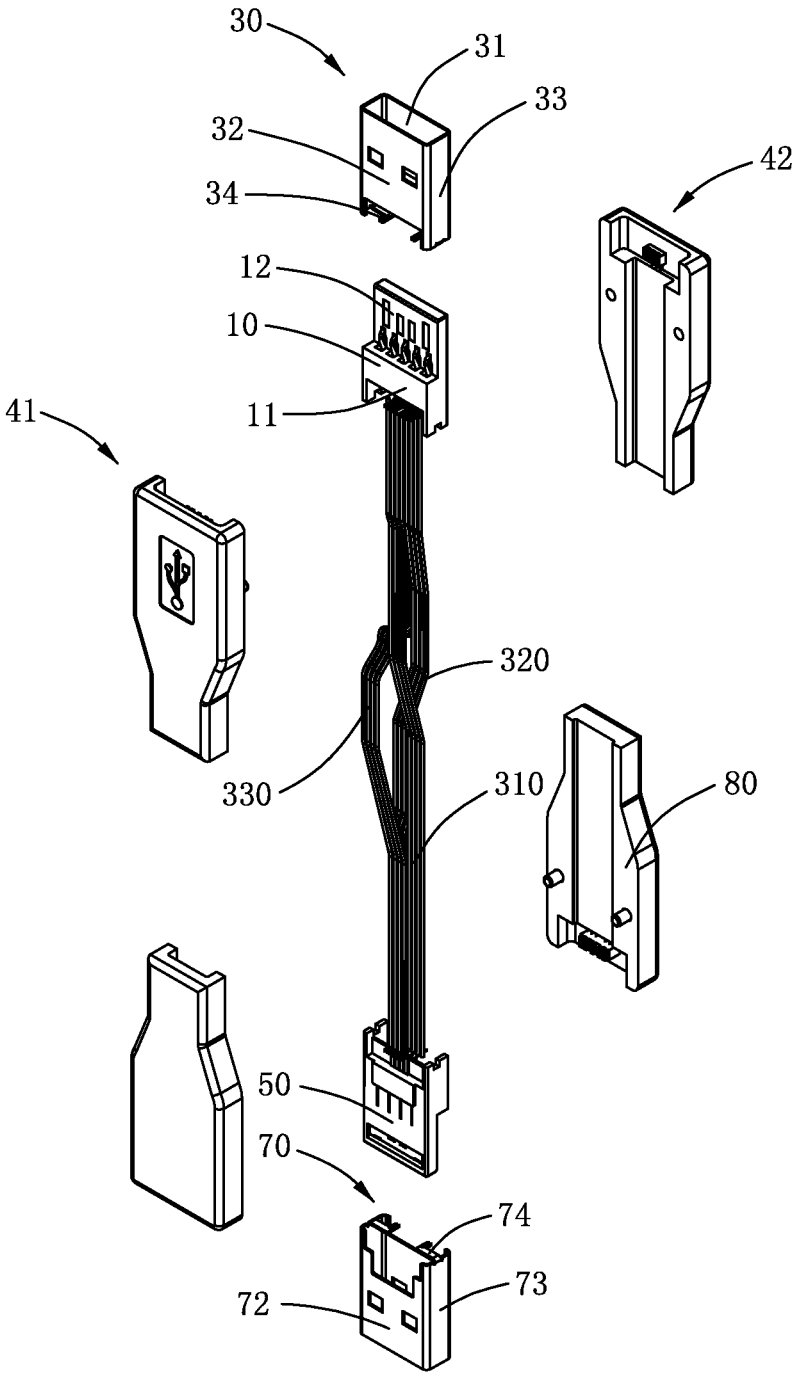
FIG. 4 is a partially exploded, perspective view of the cable connector assembly.

Referring to FIGS. 1-3, a cable connector assembly 1 in accordance with the present invention comprises a first connector or a first cable end connector 100, a second connector or a second cable end connector 200 and a ribbon cable 300 electrically and mechanically connecting the first connector 100 and the second connector 200. In the preferred embodiment, the first connector 100 is configured to meet USB 3.0 specification, and the second connector 200 has the same structure to the first connector 100. However, it is not limited that whether the first connector 100 and the second connector 200 have the same configurations.

Referring together to FIGS. 4-9, the first connector 100 comprises a first insulating housing 10, a plurality of first contacts 20 received in the first insulating housing 10, a first shielding 30 covering the first insulating housing 10 and a first insulator 40. The first insulating housing 10 includes a base portion 11 and a mating tongue 12 extending forwardly from the base portion 11.

Figure 8:
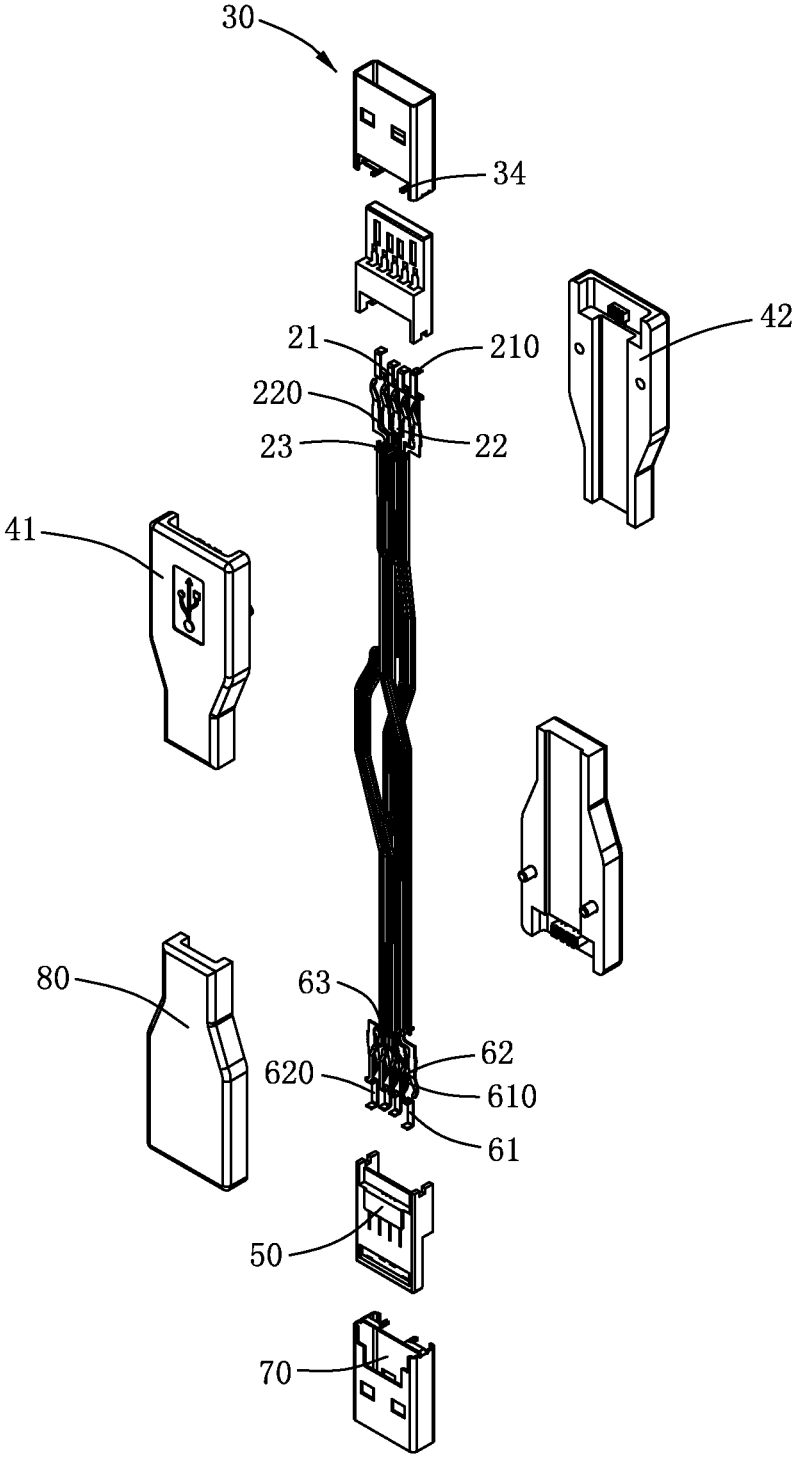
FIG. 8 is an exploded perspective view of the cable connector assembly shown in FIG. 1.
Figure 9:
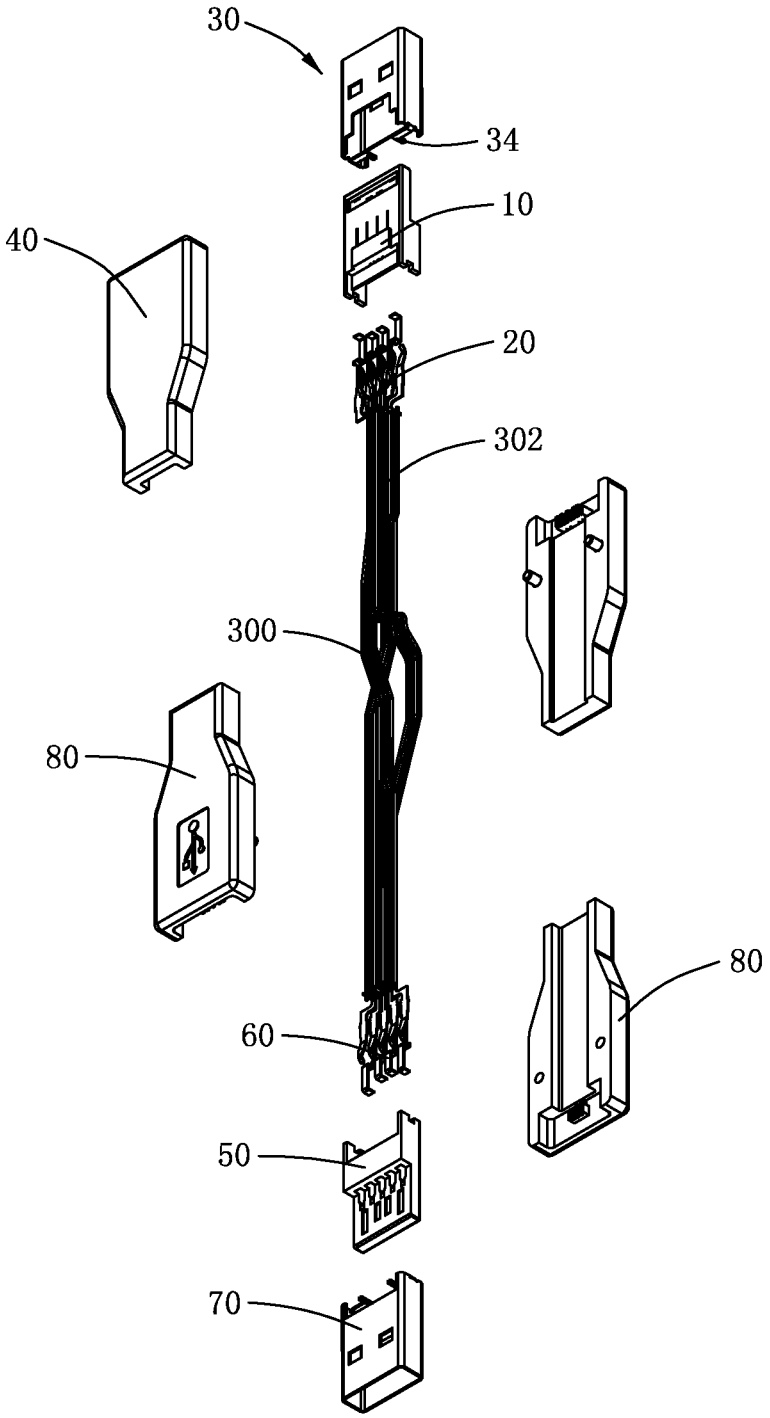
FIG. 9 is a view similar to FIG. 8 while taken from another aspect.

Turning to FIGS. 8 and 9, the plurality of first contacts 20 are assembled to the first insulating housing 10. Each of the first contacts 20 has a first contacting portion 21 for engaging with a complementary connector (not shown), a first retaining portion 22 adapted for securing the first contact 20 in the first insulating housing 10, and a first connection portion 23 electrically and mechanically connecting with the ribbon cable 300. The first contacts 20 are divided into a first group 210 and a second group 220. The first group 210 of the first contacts 20 and the second group 220 of the first contacts 20 are located at different planes. The first group 210 of the first contacts 20 includes four of first contacts 20, which are positioned side by side. The arrangement of the first group 210 of the first contacts 20 is meeting USB 2.0 specification. The first contacting portions 21 of the first group 210 of the first contacts 20 have planar plate-shaped structure and are located at the front of the mating tongue 12. The second group 220 of the first contacts 20 has five of first contacts 20, which are positioned side by side. The arrangement of the first group 210 and the second group 220 of the first contacts 20 is meeting USB 3.0 specification. The second group 220 of the first contacts 20 are located on the mating tongue 12 and arranged at the rear side of the first group 210 of the first contacts 20. The first contacting portion 21 of the second group 220 of the first contacts 20 has an elastic structure. The first connection portions 23 of the first contacts 20 are all of insulating displacement contact (IDC) type, which can be easily connected with the ribbon cable 300. Each of the first connection portions 23 include a pair of spaced arm portions (not shown), between which a receiving space is defined. In the preferred embodiment, the first contacting portions 21 and the first retaining portions 22 of the first contacts 20 are placed substantially in the same plane, while the first connection portions 23 extend along a direction perpendicular to the first retaining portion 22 and the first contacting portion 21. The first connection portions 23 of the first group 210 of the first contacts 20 and the first connection portions 23 of the second group 220 of the first contacts 20 extend towards opposite directions. In the preferred embodiment, one of the first contacts 20 in the second group 210 has a pair of first connection portions 23.

The first shielding 30 has a first top wall 31, a first bottom wall 32 opposite to the first top wall 31, a pair of first side walls 33 connecting the first top wall 31 and the first bottom wall 32, and a pair of first ground sections 34. In the preferred embodiment, one of the first ground sections 34 projects from a rear side of one of the first side walls 33 and extends towards the other one of the first side wall 33. In other words, the pair of first ground sections 34 extend towards each other. The first ground sections 34 and the first connection portions 23 are arranged parallel or in the same plane. The first ground sections 34 are positioned at opposite sides of the second group 220 of the first contacts 20. The first ground sections 34 and the first connection portions 23 of the second group 220 of first contacts 20 are aligned in a same line. The first ground section 34 is also of IDC type. As can be understood, the number and the configuration of the first ground sections in other embodiments can be different according to application requirements.

Together referring to FIGS. 1 to 9, the second connector 200 comprises a second insulating housing 50, a plurality of second contacts 60 received in the second insulating housing 50, a second shielding 70 covering the second insulating housing 50, and a second insulator 80. In the preferred embodiment, the first connector and the second connector have the same configurations.

Each of the second contacts 60 have a second contacting portion 61 for engaging with the complementary connector, a second retaining portion 62 for securing the second contact 60 in the second insulating housing 50, and a second connection portion 63 electrically connecting with the ribbon cable 300. The second contacts 60 are divided into two groups, which are first group 610 and the second group 620. The two groups of the second contacts 60 are located at different planes. The second connection portions 63 of the two groups 610, 620 are extending along opposite directions away from each other. One of the second contacts 60 in the second group 620 has a pair of second connection portions 63.

The second shielding 70 comprises a second top wall 71, a second bottom wall 72 opposite to the second top wall 71, a pair of second side walls 73 connecting the second top and bottom walls 71, 72 and a pair of second ground sections 74. The pair of second ground sections 74 project from rear side of the second side walls 73 and extend towards each other. In the preferred embodiment, the second connection portions 63 and the second ground sections 74 are all of IDC type. In use, the first connector 100 and the second connector 200 are located along opposite directions. In other words, the first connector 100 is arranged in a reversed direction with respect to the second connector 200.

The ribbon cable 300 electrically connects the first connector 100 and the second connector 200. The ribbon cable 300 comprises a plurality of wires, each of which have one end thereof connecting to the first connection portions 23 and the first ground sections 34, respectively, and have another end thereof connecting to the second connection portions 63 and the second ground sections 74, respectively. Each wire is insulated by an insulative layer 302. In the preferred embodiment, the ribbon cable 300 includes a first group of wires 310, a second group of wires 320 and a third group of wires 330, each group of which have four wires. The first group of wires 310 is used to connect part of the second group of first contacts 220 with corresponding part of second group of second contacts 620, and to connect one of the first ground sections 34 and one of the second ground sections 74. Similarly, the second group of wires 320 electrically connects rest of the second group of first contacts 220 with rest of the second group of second contacts 620, and connects the other one of first ground sections 34 with the other one of second ground sections 74. The first group of wires 310 and the second group of wires 320 are staggeredly arranged between the second group of first contacts 220 and the second group of second contacts 620. The third group of wires 330 is used to connect the first group of first contacts 210 with the first group of the second contacts 610. Opposite ends of the third group of wires 330 are positioned in different planes.

The first insulator 40 and the second insulator 80 have same structures. The first insulator 40 is assembled to outside of the first shielding 30. The first insulator 40 includes upper insulator 41 and lower insulator 42 engageable with the upper insulator 41.

Figure 5:
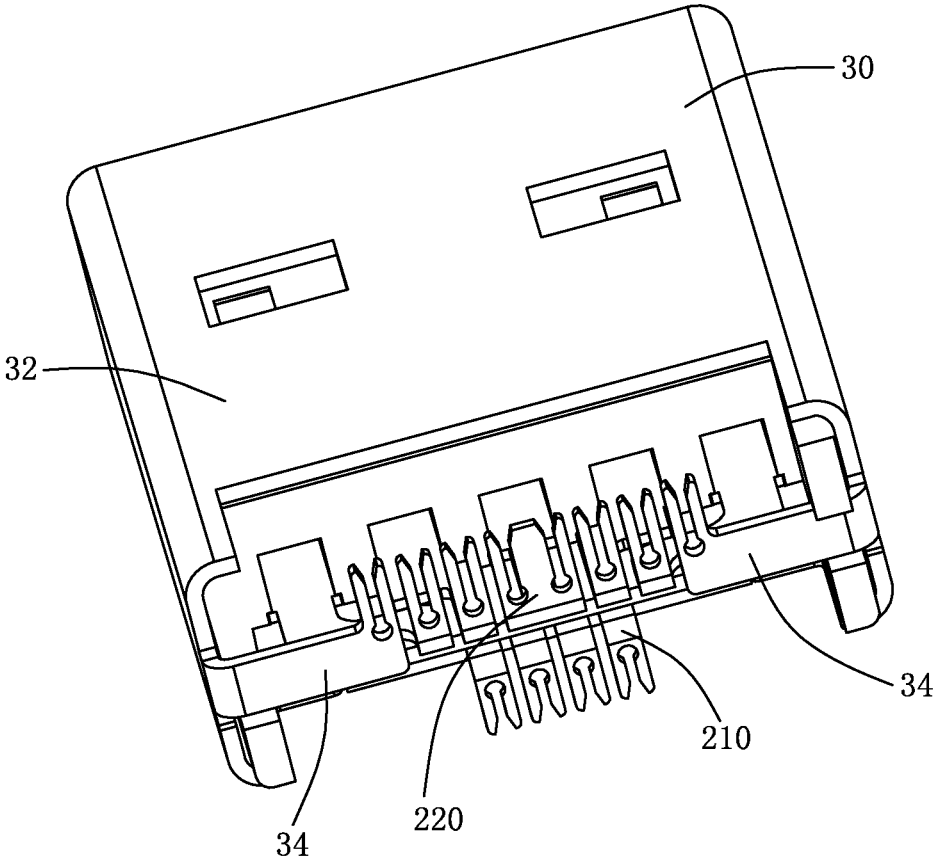
FIG. 5 is a perspective view of a first shielding of the cable connector assembly shown in FIG. 4.
Figure 6:
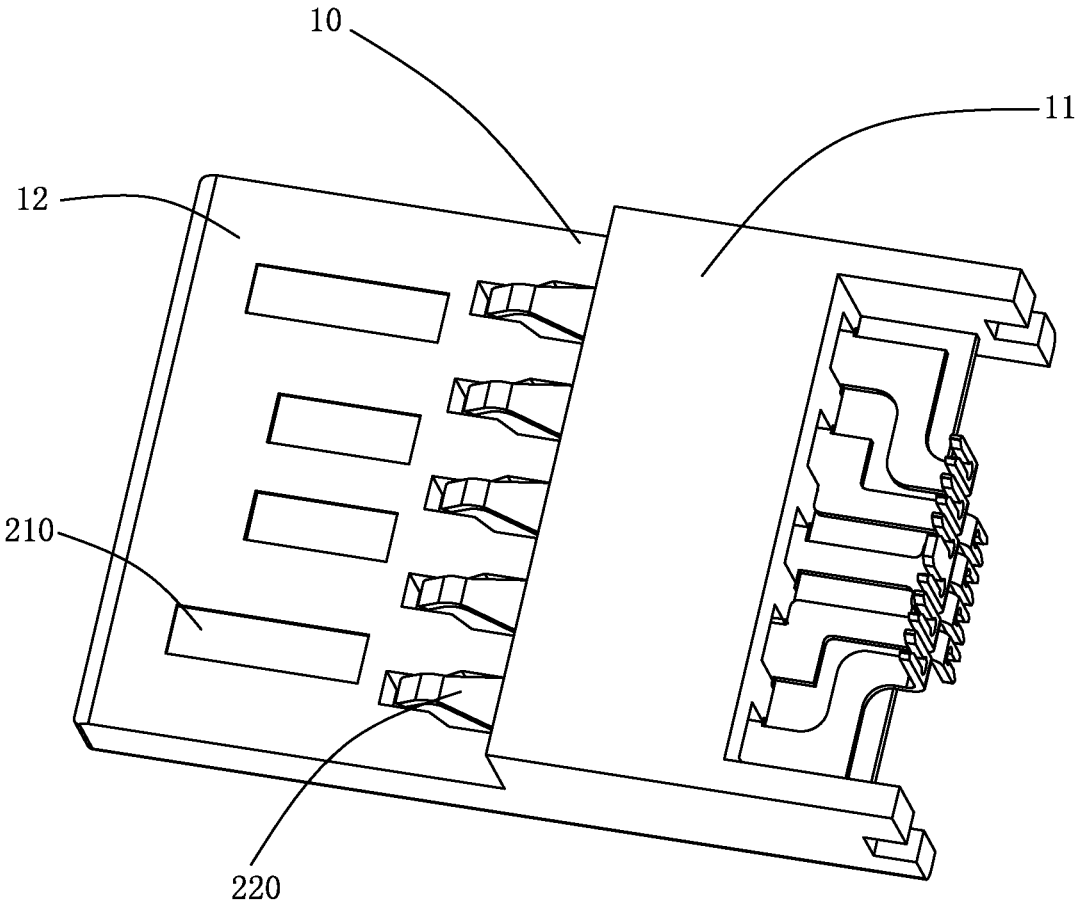
FIG. 6 is a perspective view of a first insulating housing of the cable connector assembly shown in FIG. 4.
Figure 7:
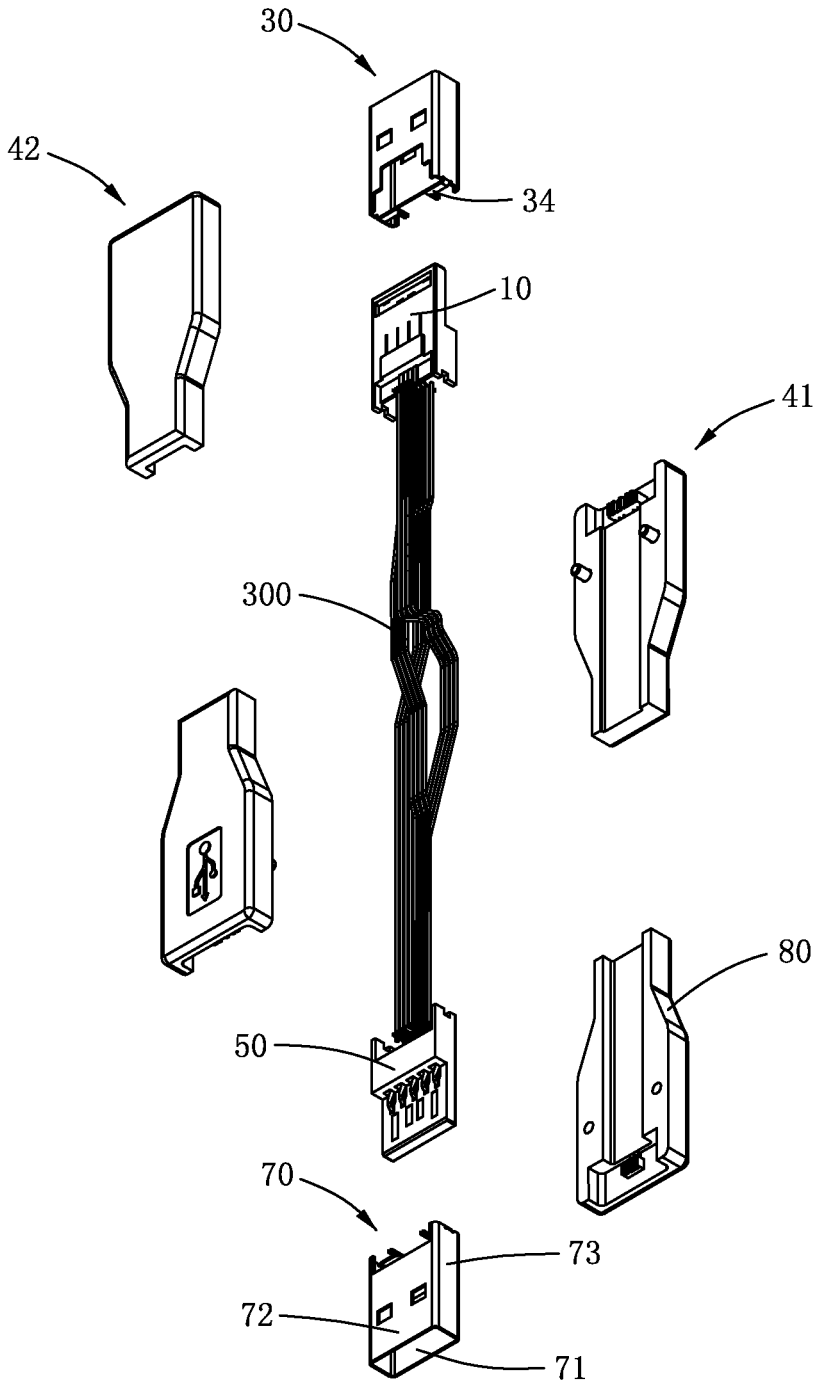
FIG. 7 is a view similar to FIG. 4 while taken from another aspect.

Referring to FIGS. 5-7, the signal terminal module 50 of the electrical connector 100 is changeably assembled to the insulating housing 10. The signal terminal module 50 includes an insulator 51 and a plurality of signal terminals 52 retained in the insulator 51.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A cable connector assembly, comprising:

a first connector, said first connector comprising:

a first insulating housing;

a plurality of first contacts assembled on said first insulating housing, each of said first contacts comprising a first contacting portion, a first retaining portion and a first connection portion;

a first shielding covering said first insulating housing, said first shielding having a first grounding section;

a second connector, said second connector comprising;

a second insulating housing;

a plurality of second contacts assembled on said second insulating housing, each of said second contacts comprising a second contacting portion, a second retaining portion and a second connection portion;

a second shielding covering said second insulating housing, said second shielding having a second ground section; and a ribbon cable electrical connecting said first and said second connector, said ribbon cable comprising a plurality wires, each wire having one end electrically connecting with said first connection portions and said first grounding section and having the other end electrically connecting said second connection portions and said second ground section.

2. The cable connector assembly as claimed in claim 1, wherein said first contacts are divided into a first group of first contacts and a second group of first contacts, and wherein said first and said second groups of first contacts extend along different planes.

3. The cable connector assembly as claimed in claim 2, wherein said second contacts are divided into a first group of second contacts and a second group of second contacts, and wherein said first and said second groups of second contacts extend along different planes.

4. The cable connector assembly as claimed in claim 3, wherein said first shielding comprises a first top wall, a first bottom wall opposite to said first top wall, a pair of first side walls connecting said first top wall and said first bottom wall, and wherein a pair of first ground sections extends oppositely from rear ends of said first side walls.

5. The cable connector assembly as claimed in claim 4, wherein said second shielding comprises a second top wall, a second bottom wall opposite to said second top wall, a pair of second side walls connecting said second top wall and said second bottom wall, and wherein a pair of second ground sections extends oppositely from rear ends of said second side walls.

6. The cable connector assembly as claimed in claim 5, wherein said plurality of wires includes a first group of wires and a second group of wires.

7. The cable connector assembly as claimed in claim 6, wherein said first group of wires electrically connect part of the second group of first contacts with part of the second group of second contacts, and connect one of first ground sections with one of second ground sections, and wherein said second group of wires electrically connect rest of the second group of first contacts with rest of the second group of second contacts, and connect the other one of first ground sections with the other one of second ground sections.

8. The cable connector assembly as claimed in claim 7, wherein said first group of wires and said second group of wires are staggeredly arranged between said first connector and said second connector.

9. The cable connector assembly as claimed in claim 8, wherein said plurality of wires further comprises a third group of wires, and wherein said third group of wires connect said first group of first contacts and said first group of second contacts, and wherein said third group of wires have opposite ends located at different planes.

10. The cable connector assembly as claimed in claim 9, wherein each group of wires comprises four wires.

11. The cable connector assembly as claimed in claim 3, wherein said first and second connection portions are of insulation displacement contacts (IDC) type.

12. The cable connector assembly as claimed in claim 11, wherein said first connection portions of said first group of first contacts and said first connection portions of said second group of first contacts extend along opposite directions away from each other.

13. The cable connector assembly as claimed in claim 12, wherein said second connection portions of said first group of second contacts and said second connection portions of said second group of second contacts extend along opposite directions away from each other.

14. The cable connector assembly as claimed in claim 13, wherein at least one of said first contacts has a pair of first connection portions, and wherein at least one of said second contacts has a pair of second connection portions.

15. A cable end connector for connecting with a ribbon cable, comprising:

an insulating housing comprising a base portion and a mating portion extending forwardly from said base portion;

a plurality of contacts received in said insulating housing, each of said contacts having a retaining portion, a contacting portion projecting from one end of said retaining portion and extending outsides of said mating portion, and a connection portion extending from another end of said retaining portion; and a shielding covering said insulating housing, said shielding having a pair of ground sections adapted for connecting with the ribbon cable;

wherein said contacts include a first group of contacts and a second group of contacts, and wherein said connection portions of said first and said second groups of contacts extend oppositely from each other.

16. The cable end connector as claimed in claim 15, wherein at least one contact has a pair of connection portions.

17. The cable end connector as claimed in claim 15, wherein said connection portion of said contact is of insulation displacement contacts (IDC) type.

18. The cable end connector as claimed in claim 15, wherein said pair of ground sections are arranged at opposite sides of said contacts, and wherein said ground sections extend parallel to said connection portions of said contacts.

19. The cable end connector as claimed in claim 15, further comprising an insulator covering said shielding.

* * * * *